US009646482B1

(12) United States Patent
Herman et al.

(10) Patent No.: US 9,646,482 B1
(45) Date of Patent: May 9, 2017

(54) LEARNED AND DYNAMIC ENTRY ALLOWANCES

(71) Applicant: Google Inc., Mountain View, CA (US)

(72) Inventors: Kenneth Louis Herman, San Jose, CA (US); Jeffery Theodore Lee, Los Gatos, CA (US); Yash Modi, San Mateo, CA (US); Jeffrey Alan Boyd, Novato, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 14/983,926

(22) Filed: Dec. 30, 2015

(51) Int. Cl.
*G08B 25/00* (2006.01)

(52) U.S. Cl.
CPC ..... *G08B 25/008* (2013.01)

(58) Field of Classification Search
CPC ..... G08B 25/008; G08B 21/22; G08B 13/00; G08B 13/1436
See application file for complete search history.

(56) References Cited

U.S. PATENT DOCUMENTS

| | | | | |
|---|---|---|---|---|
| 4,465,904 | A | 8/1984 | Gottsegen et al. | |
| 5,877,683 | A | 3/1999 | Sheasley | |
| 7,965,171 | B2 | 6/2011 | Hershkovitz et al. | |
| 8,217,780 | B2 | 7/2012 | Gilbert et al. | |
| 2008/0117029 | A1 | 5/2008 | Dohrmann et al. | |
| 2010/0045461 | A1* | 2/2010 | Caler | G08B 25/008 340/541 |
| 2010/0245088 | A1 | 9/2010 | Meier et al. | |
| 2012/0286951 | A1 | 11/2012 | Hess et al. | |
| 2016/0132099 | A1* | 5/2016 | Grabau | G06K 9/00771 713/323 |

* cited by examiner

*Primary Examiner* — Curtis Odom
(74) *Attorney, Agent, or Firm* — Morris & Kamlay LLP

(57) ABSTRACT

A system includes a plurality of sensors installed at a premises to capture data from an environment, a memory configured to store data captured over at least a first period of time, and a processor configured to determine, based on the stored captured data, an estimate travel time for a user to enter the premises and disarm an alarm system installed in the premises, and to set an entry allowance of the alarm system to the estimate travel time when one or more of the plurality of sensors detects an entry into the premises.

19 Claims, 7 Drawing Sheets

| Time | Device | Data | |
|---|---|---|---|
| 9/17/2015 5:45:00 PM | FD ED01 | Front door open | 610 |
| 9/17/2015 5:45:00 PM | System | Alarm activated/Entry allowance set | 620 |
| 9/17/2015 5:45:02 PM | LR CAM01 | Individual detected in living room | |
| 9/17/2015 5:45:04 PM | LR CAM01 | Individual in LR identified as C | |
| 9/17/2015 5:45:06 PM | KN THERM01 | Sound detected in kitchen | |
| 9/17/2015 5:45:08 PM | CONTROLLER | Alarm deactivated | 630 |
| | ... | | |
| 9/18/2015 5:46:10 PM | FD ED01 | Front door open | |
| 9/18/2015 5:46:10 PM | System | Alarm activated/Entry allowance set | |
| 9/18/2015 5:46:12 PM | LR CAM01 | Individual detected in living room | |
| 9/18/2015 5:46:14 PM | FD ED01 | Individual in LR identified as C | |
| 9/18/2015 5:46:17 PM | KN THERM01 | Sound detected in kitchen | |
| 9/18/2015 5:46:19 PM | CONTROLLER | Alarm deactivated | |
| | ... | | |

600

FIG. 6

| Estimate Travel Time | Metadata |
|---|---|
| 22 sec | strict=low |
| 11 sec | time=evening; entrance=front_door; individual=C; season=winter; strict=high |
| 18 sec | time=evening; entrance=front_door; individual=C; season=winter; strict=low |
| 9 sec | time=afternoon; entrance=side_door; individual=unknown; season=winter; strict=low |
| 15 sec | time=night; entrance=side_door; individual=B; season=winter; strict=low |
| | ... |

710

720

700

FIG. 7

LEARNED AND DYNAMIC ENTRY ALLOWANCES

BACKGROUND

Homes, offices, and other buildings may be equipped with smart networks to provide automated control of devices, appliances and systems, such as heating, ventilation, and air conditioning ("HVAC") system, lighting systems, home theater, entertainment systems, as well as security systems. A security system may include one or more sensors installed throughout a premises. The one or more sensors may, for example, detect movement or changes in light, sound, or temperature.

Security system modes may include "STAY", "AWAY" and "HOME" modes. In a STAY mode the security system may operate under the assumption that authorized parties are present within the premises but will not be entering/leaving without notifying the system; therefore data from certain interior sensors may be given lower weight in determining whether an unauthorized party is present. In an AWAY mode the security system may operate under the assumption that no authorized parties are in the premises; therefore data from all sensors, interior and exterior, may be accorded high weight in determining whether an unauthorized party is present or attempting to enter the premises. In a HOME mode the security system may operate under the assumption that authorized parties are within the premises and will be freely entering/leaving the premises without notifying the system; therefore data from certain sensors interior and exterior may be accorded low weight in determining whether an unauthorized party is present.

When a security system is in AWAY mode, an authorized user may enter the premises. In response, the security system will not immediately trigger an alarm, but will instead give the user an "entry allowance", that is, a designated amount of time to enter the premises and authenticate to the system that the user is an authorized individual.

BRIEF SUMMARY

According to an embodiment of the disclosed subject matter, a system includes a plurality of sensors installed at a premises to capture data from an environment, a memory configured to store data captured over at least a first period of time, and a processor configured to determine, based on the stored captured data, an estimate travel time for a user to enter the premises and disarm an alarm system installed in the premises, and to set an entry allowance of the alarm system to the estimate travel time when one or more of the plurality of sensors detects an entry into the premises According to an embodiment of the disclosed subject matter, a method of controlling an entry allowance, includes capturing data with a plurality of network connected sensors installed in or around a premises, storing the data in an electronic storage device over a period of time, analyzing the stored data with a processor to determine, based on the stored data and on recently captured data, an estimate travel time for a user to disarm an alarm system installed in the premises, and setting an entry allowance time for a security system based on the estimate travel time when the recently captured data indicates that an individual has entered the premises.

According to an embodiment of the disclosed subject matter, a system includes one or more sensor devices to capture data that indicates information about an environment, a memory device that stores a log of the captured data, a database of one or more estimate travel times, and one or more computer executable components, and a processor to execute the following computer executable components in the memory: an entry allowance calculator component to calculate the one or more estimate travel times based on the log of the captured data, an entry allowance database component to store the one or more estimate travel times in the memory device with associated metadata that indicates a situation to which the corresponding estimate travel time applies, and an entry allowance designator to set an entry allowance time based on recently captured data from the one more sensors and the stored estimate travel times.

According to an embodiment of the disclosed subject matter, means for capturing data with a plurality of network connected sensors installed in or around a premises, storing the data in an electronic storage device over a period of time, analyzing the stored data with a processor to determine, based on the stored data and on recently captured data, an estimate travel time for a user to disarm an alarm system installed in the premises, and setting an entry allowance time for a security system based on the estimate travel time when the recently captured data indicates that an individual has entered the premises are provided.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

FIG. 6 shows an example data log according an embodiment of the disclosed subject matter.

FIG. 7 shows an example entry allowance database according to an embodiment of the disclosed subject matter.

DETAILED DESCRIPTION

Figure 1:
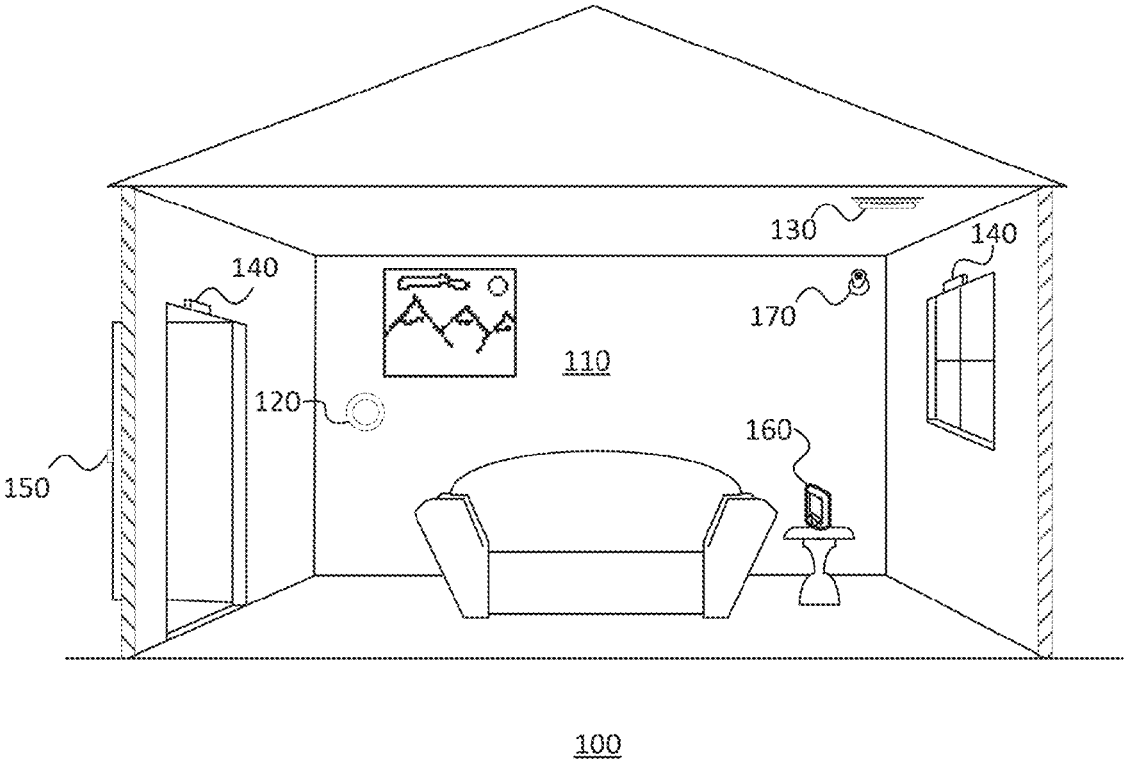
FIG. 1 shows an example premises management system according to an embodiment of the disclosed subject matter.

Various aspects or features of this disclosure are described with reference to the drawings, wherein like reference numerals are used to refer to like elements throughout. In this specification, numerous details are set forth in order to provide a thorough understanding of this disclosure. It should be understood, however, that certain aspects of disclosed subject matter may be practiced without these specific details, or with other methods, components, materials, etc. In other instances, well-known structures and devices are shown in block diagram form to facilitate describing the subject disclosure.

Some portions of the detailed description are presented in terms of algorithms and symbolic representations of operations on data bits within a computer memory. These algorithmic descriptions and representations are commonly used by those skilled in the data processing arts to most effectively convey the substance of their work to others skilled in the art. An algorithm is here and generally, conceived to be a self-consistent sequence of steps leading to a result. The steps are those requiring physical manipulations of physical quantities. Usually, though not necessarily, these quantities take the form of electrical or magnetic signals capable of being stored, transferred, combined, compared and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "receiving," "determining," "analyzing," "testing," "identifying," "sending," "storing," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Before providing a detailed discussion of the figures, a brief overview will be given to guide the reader. The disclosed subject matter relates to a smart security system that may dynamically and automatically 'learn' to determine and set a customized entry allowance for disarming an alarm. Herein, the term "entry allowance" will generally refer to the amount of time that a security system provides a user to, for example, enter a pin, swipe a card, provide authentication information, or otherwise disarm an alarm after the system detects the user's entry into the premises.

Often, a manufacturer may set an arbitrary entry allowance for an alarm system. This initial setting normally does not take into account the actual installation setting of a user's specific premises and may be far more time than a user actually needs in order to enter the premises and disarm the alarm. Even if the user adjusts the setting manually, the new setting is a fixed setting that does not take into account the dynamics that may be involved during entry. Furthermore, during the full length of time that the entry allowance is counting down, the system remains in a waiting mode in which the alarm will not be triggered, exposing the premises to a lengthy vulnerability.

The disclosed smart security system may determine a customized entry allowance based on recent data obtained by sensors, historical data obtained by sensors, other input data, and additional factors as will be described below. The disclosed smart security system may store data that has been captured by sensors and analyze the data to extract information about the environment, such as temperature, sound, lighting, presence/absence of a person/pet, motion, etc. Stored data may be time-logged and may indicate changes in the environment that serve as a recordation of physical events, such as entry, exit, through-movement, etc., or changes in the structure of the premises such as a door opening, a window closing, etc., or possibly various types of false alerts.

The disclosed smart security system may also share data with and receive data from other systems installed at the premises or accessible through a network, e.g., the Internet or cloud-based services. For illustrative purposes and to demonstrate example coordination and communications among different types of systems, the disclosed smart security system will be described below as part of a smart home network environment, which will be referred to generically as a "premises management system."

A "premises management system" as described herein may include a plurality of electrical and/or mechanical components, including intelligent, sensing, network-connected devices that communicate with each other and/or may communicate with a central server or a cloud-computing system to provide any of a variety of security and/or environment management objectives in a home, office, building or the like. Such objectives will collectively be referred to as "premises management," and may include, for example, managing alarms, notifying third parties of alarm situations, managing door locks, monitoring the premises, as well as managing temperature, managing lawn sprinklers, controlling lights, controlling media, etc.

A premises management system may include multiple systems or subsystems to manage different aspects of premises management. For example, the disclosed smart security subsystem may manage the arming, disarming, and activation of alarms and other security aspects of the premises, while a smart home environment subsystem may handle aspects such as light, lawn watering and automated appliances, and an HVAC subsystem may handle temperature adjustments. Each subsystem may include devices, such as sensors, that obtain information about the environment.

The individual hardware components of the premises management system that are used to monitor and affect the premises in order to carry out premises management in general will hereinafter be referred to as "premises management devices." Premises management devices may include multiple physical hardware and firmware configurations, along with circuitry hardware (e.g., processors, memory, etc.), firmware, and software programming that are capable of carrying out the objectives and functions of the premises management system. The premises management devices may be controlled by a "brain" component, as will be described further below, which may be implemented in a controller device or in one or more of the premises management devices.

Turning now to a more detailed discussion in conjunction with the attached figures, FIG. 1 shows an example premises management system 100 that may include the disclosed smart security system. The system 100 may be installed within a premises 110. The system 100 may also include multiple types of premises management devices, such as one or more intelligent, multi-sensing, network-connected thermostats 120, one or more intelligent, multi-sensing, network-connected hazard detection units 130, one or more intelligent, multi-sensing, network-connected entry detection units 140, one or more network-connected door handles 150, one or more intelligent, multi-sensing, network-connected controller devices 160, and one or more intelligent, multi-sensing, network-connected camera devices 170. Data captured by any of these or other devices may be used by the disclosed smart security system or a different subsystem.

The premises management system 100 may be configured to operate as a learning, evolving ecosystem of interconnected devices. New premises management devices may be added, for example, to introduce new functionality, expand existing functionality, or expand a spatial range of coverage of the system. Furthermore, existing premises management devices may be replaced or removed without causing a failure of the system 100. Such removal may encompass intentional or unintentional removal of components from the system 100 by an authorized user, as well as removal by malfunction (e.g., loss of power, destruction by intruder, etc.). Due to the dynamic nature of the system 100, the overall capability, functionality and objectives of the system 100 may change as the constitution and configuration of the system 100 change. The types of data that may be used by the disclosed smart security system may also correspondingly change. For example, data that indicates environmental sound may be available in one configuration while data that indicates environmental temperature may be available in another configuration.

In order to avoid contention and race conditions among interconnected devices, the disclosed smart security system and the handling of certain system level decisions may be centralized in a "brain" component. The brain component may coordinate decision making across subsystems, the entire system 100, or a designated portion thereof. The brain component is a system element at which, for example, sensor/detector states converge, user interaction is interpreted, sensor data is received, subsystems are coordinated, and decisions are made concerning the state, mode, or actions of the system 100. Hereinafter, the system 100 brain component will be referred to as the "primary system processor." The primary system processor may be implemented, for example, in the controller device 160, via software executed or hard coded in a single device, or in a "virtual" configuration, distributed among one or more external servers or one or more premises management devices within the system. The virtual configuration may use computational load sharing, time division, shared storage, and other techniques to handle the primary system processor functions.

The primary system processor may be configured to implement the disclosed smart security system and to execute software to control and/or interact with the other subsystems and components of the premises management system 100. Furthermore, the primary system processor may be communicatively connected to control, receive data from, and transmit data to premises management devices within the system 100 as well as to receive data from and transmit data to devices/systems external to the system 100, such as third party servers, cloud servers, mobile devices, and the like.

Premises management devices (e.g., 120-150, 170) may include one or more sensors. In general, a "sensor" may refer to any device that can obtain data that provides an indication of a state or condition of its local environment. Such data may be stored or accessed by other devices and/or systems/subsystems. Sensor data may serve as the basis for information determined about the sensor's environment and as the basis for decisions made by the disclosed security system.

Any premises management device that can capture data from the environment can be used as a data source for the disclosed smart security system. A brief description of sensors that can function as data sources that may be included in the system 100 follows.

The examples provided below are not intended to be limiting but are merely provided as illustrative subjects to help facilitate describing the subject matter of the present disclosure. It would be impractical and inefficient to list and describe every type of possible sensor/data source. It should be understood that deployment of types of sensors that are not specifically described herein will be within the capability of one with ordinary skill in the art.

Sensors may be described by the type of information they collect. In this nomenclature sensor types may include, for example, motion, smoke, carbon monoxide, proximity, temperature, time, physical orientation, position, acceleration, location, entry, presence, pressure, light, sound, and the like. A sensor also may be described in terms of the particular physical device that obtains the environmental data. For example, an accelerometer may obtain acceleration data, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combination thereof.

A sensor further may be described in terms of a function or functions the sensor performs within the system 100. For example, a sensor may be described as a security sensor when it is used to determine security events, such as entry or exit through a door.

A sensor may serve different functions at the same time or at different times. For example, system 100 may use data from a motion sensor to determine the occurrence of an event, e.g., "individual entered room," or to determine how to control lighting in a room when an individual is present, or use the data as a factor to change a mode of a security system on the basis of unexpected movement when no authorized party is detected to be present. In another example, the system 100 may use the motion sensor data differently when a security system is in an AWAY mode versus a HOME mode. A security system may ignore data from certain interior motion sensors while the system 100 is in a HOME mode and act upon data from those interior motion sensors when the security system is in an AWAY mode.

In some cases, a sensor may operate to gather data for multiple types of information sequentially or concurrently. For example, a temperature sensor may be used to detect a change in atmospheric temperature as well as to detect the presence of a person or animal. A sensor also may operate in different modes (e.g., different sensitivity or threshold settings) at the same or different times. For example, a sensor may be configured to operate in one mode during the day and another mode at night.

Multiple sensors may be arranged in a single physical housing, such as where a single device includes movement, temperature, magnetic, and/or other sensors. Such a housing may still be generally referred to as a "sensor" or premises management device.

Figure 2:
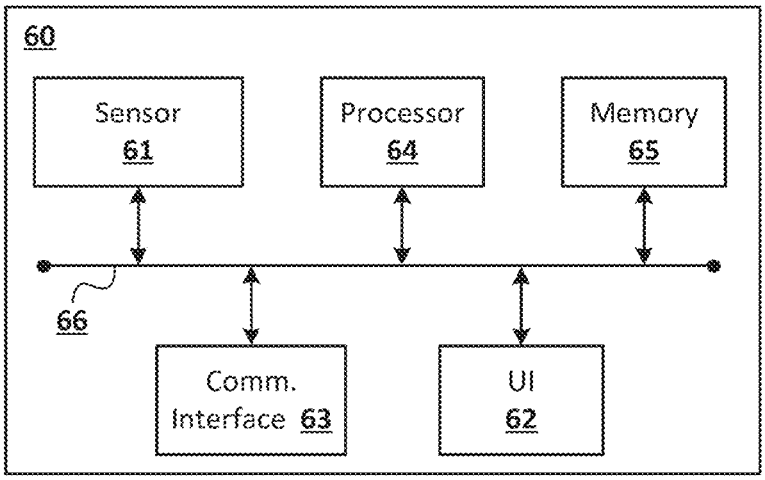
FIG. 2 shows an example premises management device according to an embodiment of the disclosed subject matter.

FIG. 2 shows an example premises management device 60 including a processor 64, a memory 65, a user interface 62, a communications interface 63, an internal bus 66, and a sensor 61. A person of ordinary skill in the art would appreciate that components of the premises management device 60 described herein can include electrical circuit(s) that are not illustrated, including components and circuitry elements of sufficient function in order to implement the device as required by embodiments of the subject disclosure. Furthermore, it can be appreciated that many of the various components listed above can be implemented on one or more integrated circuit (IC) chips. For example, a set of components can be implemented in a single IC chip, or one or more components may be fabricated or implemented on separate IC chips.

The sensor 61 may be an environmental sensor, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, pressure sensor, microphone, imager, camera, compass or any other type of sensor that captures data or provides a type of information about the environment in which the premises management device 60 is located.

The processor 64 may be a central processing unit (CPU) or other type of processor chip, or circuit. The processor 64 may be communicably connected to the other components of the premises management device 60, for example, to receive, transmit and analyze data captured by the sensor 61, transmit messages, packets, or instructions that control operation of other components of the premises management device 60 and/or external devices, and process communication transmissions between the premises management device 60 and other devices. The processor 64 may execute instructions and/or computer executable components stored on the memory 65. Such computer executable components may include, for example, a primary function component to control a primary function of the premises management device 60 related to managing a premises, a communication component configured to locate and communicate with other compatible premises management devices, and a computational component configured to process system related tasks.

The memory 65 or another memory device in the premises management device 60 may store computer executable components and also be communicably connected to receive and store environmental data captured by the sensor 61. A communication interface 63 may function to transmit and receive data using a wireless protocol, such as a WiFi, Thread, other wireless interfaces, Ethernet, other local network interfaces, Bluetooth®, other radio interfaces, or the like, and may facilitate transmission and receipt of data by the premises management device 60 to and from other devices.

The user interface (UI) 62 may provide information and/or receive input from a user of system 100. The UI 62 may include, for example, a speaker to output an audible sound when an event is detected by the premises management device 60. Alternatively, or in addition, the UI 62 may include a light to be activated when an event is detected by the premises management device 60. The user interface may be relatively minimal, such as a liquid crystal display (LCD), light-emitting diode (LED) display, an LED or limited-output display, or it may be a full-featured interface such as, for example, a touchscreen, touchpad, keypad, or selection wheel with a click-button mechanism to enter input.

Internal components of the premises management device 60 may communicate via the internal bus 66 or other mechanisms, as will be readily understood by one of skill in the art. One or more components may be implemented in a single physical arrangement, such as where multiple components are implemented on a single integrated circuit. Premises management devices 60 as disclosed herein may include other components, and/or may not include all of the illustrative components shown.

As previously mentioned, sensor 61 captures data about the environment around the device 60, and at least some of the data may be translated into information that may be used by the disclosed smart security system to automatically control the entry allowance. Through the bus 66 and/or communication interface 63, time settings, calculations and other functions may be transmitted to or accessible by other components or subsystems of the premises management system 100.

Figure 3:
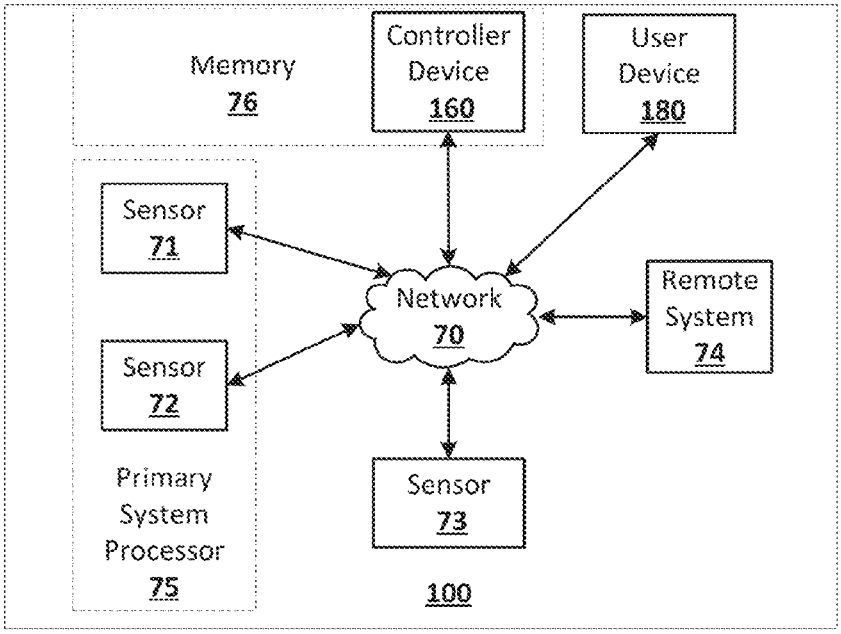
FIG. 3 shows a diagram example of a premises management system which may include an embodiment of the smart security system according to an embodiment of the disclosed subject matter.

FIG. 3 shows a diagram example of a premises management system 100 which may include an embodiment of the smart security system as disclosed herein. System 100 may be implemented over any suitable wired and/or wireless communication networks. One or more premises management devices, i.e., sensors 71, 72, 73, and one or more controller devices 160 (e.g., controller device 160 as shown in FIG. 1) may communicate via a local network 70, such as a WiFi or other suitable network, with each other. The network 70 may include a mesh-type network such as Thread, which provides network architecture and/or protocols for devices to communicate with one another. A user may interact with the premises management system 100, for example, using a user device 180, such as a computer, laptop, tablet, mobile phone, watch, wearable technology, mobile computing device, or using the controller device 160.

In the diagram of FIG. 3 a primary system processor 75 is shown implemented in a distributed configuration over sensors 71 and 72, and a memory 76 is shown implemented in controller device 160. However, the controller device 160 and/or any one or more of the sensors 71, 72, 73, may be configured to implement the primary system processor 75 and memory 76 or any other storage component required to store data and/or applications accessible by the primary system processor 75. The primary system processor 75 may implement the disclosed smart security system and may receive, aggregate, analyze, and/or share information received from the sensors 71, 72, 73, and the controller device 160. Furthermore, a portion or percentage of the primary system processor 75 and/or memory 76 may be implemented in a remote system 74, such as a cloud-based reporting and/or analysis system.

The premises management system 100 shown in FIG. 3 may be a part of a smart-home environment which may include a structure, such as a house, apartment, office building, garage, factory, mobile home, or the like. The system 100 can control and/or be coupled to devices and systems inside or outside of the structure. One or more of the sensors 71, 72 may be located inside the structure or outside the structure at one or more distances from the structure (e.g., sensors 71, 72 may be disposed at points along a land perimeter on which the structure is located, such as a fence or the like).

Sensors 71, 72, 73 may communicate with each other, the controller device 160 and the primary system processor 75 within a private, secure, local communication network that may be implemented wired or wirelessly, and/or a sensor-specific network through which sensors 71, 72, 73 may communicate with one another and/or with dedicated other devices. Alternatively, as shown in FIG. 3, one or more sensors 71, 72, 73 may communicate via a common local network 70, such as a Wi-Fi, Thread or other suitable network, with each other and/or with a controller 160 and primary system processor 75. Sensors 71, 72, 73 may also be configured to communicate directly with the remote system 74.

Sensors 71, 72, 73 may be implemented in a plurality of premises management devices, such as intelligent, multi-sensing, network-connected devices, that can integrate seamlessly with each other and/or with a central processing system or a cloud-computing system (e.g., primary system processor 75 and/or remote system 74). Such devices may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entry-way interface devices (e.g., "smart doorbells"). The smart hazard detectors, smart thermostats, and smart doorbells may be the sensors 71, 72, 73 shown in FIG. 3. These premises management devices may be used by the disclosed smart security system to control entry allowances, but may also execute a separate, primary function.

For example, a smart thermostat may detect ambient climate characteristics (e.g., temperature and/or humidity) and may be used to control an HVAC system. In other words, ambient client characteristics may be detected by sensors 71, 72, 73 shown in FIG. 3, and the controller 160 may control the HVAC system (not shown) of the structure. However, a pattern of low temperature detected by sensors 71, 72, 73 over a period of time or at a regular interval as part of an entry pattern may also provide data that can serve as the basis for determining an entry path, a particular entrance or other factor that may affect the entry allowance determination, as will be described further below.

As another example, a smart hazard detector may detect light and the presence of a hazardous substance or a substance indicative of a hazardous substance (e.g., smoke, fire, or carbon monoxide). Light, smoke, fire, carbon monoxide, and/or other gasses may be detected by sensors 71, 72, 73 shown in FIG. 3, and the controller 160 may control an alarm system to provide a visual and/or audible alarm to the user of the smart-home environment based on data from sensor 71. However, data captured sensor 71 regarding light in a room over a period of time may also be used by the disclosed smart security system to determine an entry path or other additional information that may be used to calculate an entry allowance.

As another example, one or more intelligent, multi-sensing, network-connected entry detectors (e.g., "smart entry detectors") may be specifically designed to function as part of the disclosed smart security system. Such detectors may be or include one or more of the sensors 71, 72, 73 shown in FIG. 3. The smart entry detectors may be disposed at one or more windows, doors, and other entry points of the smart-home environment for detecting when a window, door, or other entry point is opened, broken, breached, and/or compromised. The smart entry detectors may generate a corresponding detection signal to be transmitted to the controller 160, primary system processor 75, and/or the remote system 74 when a window or door is opened, closed, breached, and/or compromised. The detection signal may provide data to the disclosed smart security system in order to serve as the basis for determining which specific entrance among a plurality of entrances a user has entered, which may be another factor in determining an entry allowance.

Smart thermostats, smart hazard detectors, smart doorbells, smart entry detectors, and other premise management devices of the system 100 (e.g., as illustrated as sensors 71, 72, 73 of FIG. 3) can be communicatively connected to each other via the network 70, and to the controller 160, primary system processor 75, and/or remote system 74.

The disclosed smart security system may also include user specific features. Generally, users of the premises management system 100 may interact with the system 100 at varying permission and authorization levels. For example, users may have accounts of varying class with the system 100, each class having access to different features (such as the ability to adjust a set entry allowance or to enable features such as user specific entry allowances.)

Users may be identified as account holders and/or verified for communication of control commands. For example, some or all of the users (e.g., individuals who live in a home) can register an electronic device, token, and/or key FOB with the premises management system 100 to enable to system 100 to identify the users and provide customized services. Such registration can be entered, for example, at a website, a system 100 interface (e.g., controller device 160), or a central server (e.g., the remote system 74) to bind the user and/or the electronic device to an account recognized by the system 100. Registered electronic devices may be permitted to control certain features of the system 100, for example to remotely access a user's custom entry allowance in the disclosed smart system.

Alternatively, or in addition to registering electronic devices, the premises management system 100 may make inferences about which individuals reside or work in the premises and are therefore users and which electronic devices are associated with those individuals. As such, the system 100 may "learn" who is a user (e.g., an inferred authorized user) and may respond to communications from the electronic devices associated with those individuals, e.g., executing applications to control the network-connected smart devices of the system 100 or to confirm or customize features of the smart security system.

Referring to FIG. 3, the controller device 160 may be implemented using a general- or special-purpose computing device. A general-purpose computing device running one or more applications, for example, may collect and analyze data from one or more sensors 71, 72, 73 installed in the premises and thereby function as controller device 160. In this case, the controller device 160 may be implemented using a computer, mobile computing device, mobile phone, tablet computer, laptop computer, personal data assistant, wearable technology, or the like. In another example, a special-purpose computing device may be configured with a dedicated set of functions and a housing with a dedicated interface for such functions. This type of controller device 160 may be optimized for certain functions and presentations, for example, including an interface specially designed to review a data log of the disclosed smart security system and create customized entry allowance rules, as will be described further below.

The controller device 160 may function locally with respect to the sensors 71, 72, 73 with which it communicates and from which it obtains sensor data, such as in the case where it is positioned within a home that has a premises management system 100 installed therein. Alternatively or in addition, controller device 160 may be remote from the sensors 71, 72, 73, such as where the controller device 160 is implemented as a cloud-based system that communicates with multiple sensors 71, 72, 73, which may be located at multiple locations and may be local or remote with respect to one another.

Figure 4:
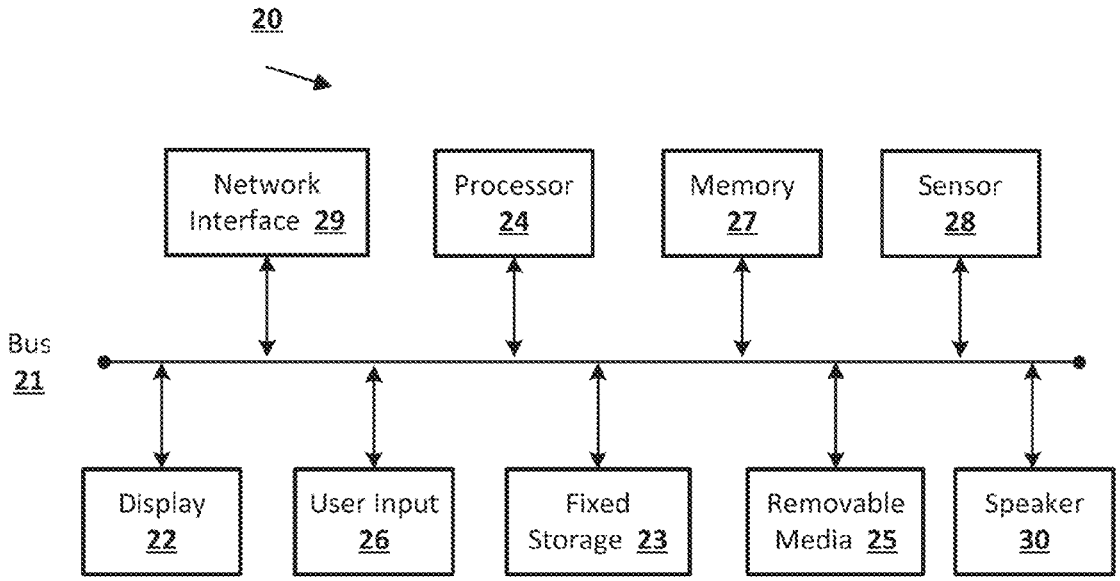
FIG. 4 shows an example computing device suitable for implementing a controller device according to an embodiment of the disclosed subject matter.

FIG. 4 shows an example computing device 20 suitable for implementing the controller device 160. The computing device 20 may include a bus 21 that interconnects major components of the computing device 20. Such components may include a central processor 24; a memory 27, such as Random Access Memory (RAM), Read Only Memory (ROM), flash RAM, or the like; a sensor 28, which may include one or more sensors as previously discussed herein; a user display 22, such as a display screen; a user input interface 26, which may include one or more user input devices such as a keyboard, mouse, keypad, touch pad, turn-wheel, and the like; a fixed storage 23 such as a hard drive, flash storage, and the like; a removable media component 25 operable to control and receive a solid-state memory device, an optical disk, a flash drive, and the like; a network interface 29 operable to communicate with one or more remote devices via a suitable network connection; and a speaker 30 to output an audible communication to the user. In some embodiments the user input interface 26 and the user display 22 may be combined, such as in the form of a touch screen.

The bus 21 allows data communication between the central processor 24 and one or more memory components 25, 27, which may include RAM, ROM, and other memory, as previously noted. Applications resident with the computing device 20 are generally stored on and accessed via a non-transitory computer readable storage medium.

The fixed storage 23 may be integral with the computing device 20 or may be separate and accessed through other interfaces. The network interface 29 may provide a direct connection to the premises management system and/or a remote server via a wired or wireless connection. The network interface 29 may provide such connection using any suitable technique and protocol, as will be readily understood by one of skill in the art, including digital cellular telephone, WiFi, Thread, Bluetooth®, near-field, and the like. For example, the network interface 29 may allow the computing device 20 to communicate with other components of the premises management system, other computers via one or more local, wide-area, or other communication networks, as described in further detail herein.

The computing device 20 may be implemented as a free-standing, portable device, or as a wall-mounted device installed in a room, or in any other implementation that allows a user to access the device.

Figure 5A:
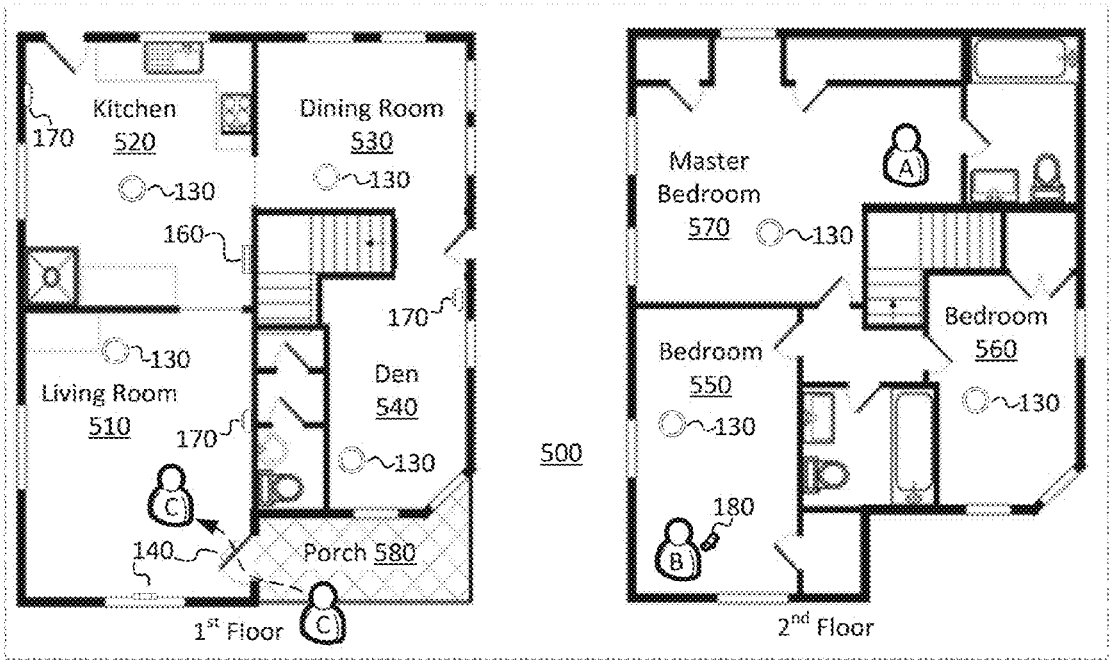
FIG. 5A shows a layout of a two-floor house 500 including a premises management system installed therein according to an embodiment of the disclosed subject matter.

FIG. 5A shows a layout of a two-floor house 500 including an example premises management system as described above installed therein. The house 500 includes a living room 510, kitchen 520, dining room 530, den 540, bedroom 550, bedroom 560, master bedroom 570, and porch 580. Authorized individual A, B, and C are present within the house 500. Individual B is carrying a mobile phone 180.

A premises management system 100 installed in the house 500 includes an embodiment of the disclosed smart security system. Referring to FIGS. 1 and 5, the system 100 may include network-connected hazard detection units 130 installed throughout the house 500, network-connected entry detection units 140 installed at windows and doors throughout the house, a network-connected controller device 160, and network connected cameras 170. For simplicity and to avoid unnecessary clutter in the figure, only one window entry detection unit 140, one door entry detection unit 140, and two cameras 170 are illustrated, but it should be understood that entry detection units 140 may be installed at multiple windows and/or doors throughout the house 500, cameras 170 may be installed in other rooms and outside of the house 500, and that other premise management devices (e.g., smart thermostats, smart doorbells, motion detectors, light detectors etc.) as described above may be installed as part of the system 100.

Figure 5B:
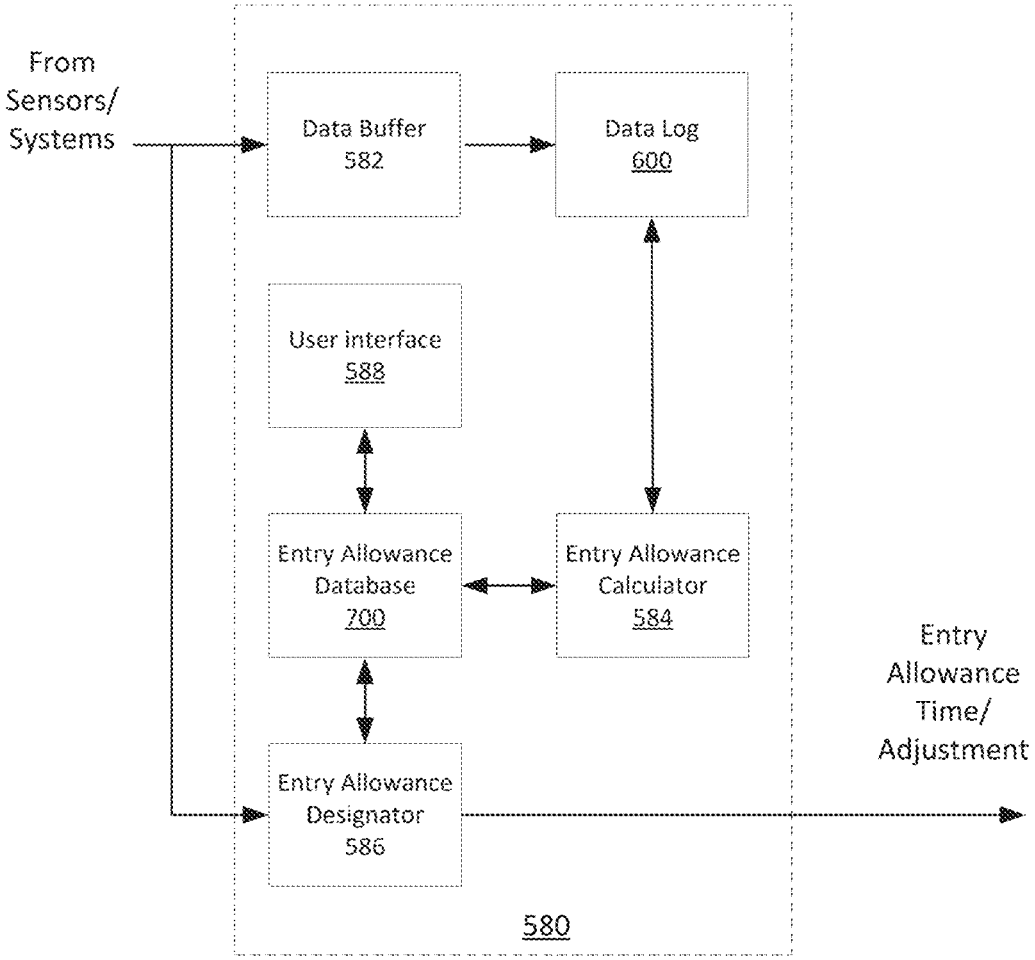
FIG. 5B shows a smart security system according to an embodiment of the disclosed subject matter.

FIG. 5B shows an embodiment of a smart security system 580 that may be implemented within the premises management system 100 in the premises 500. The smart security system 580 may include, among other components, an optional data buffer 582, a data log 600, an entry allowance calculator 584, an entry allowance database 700, an entry allowance designator 586, and a user interface 588.

The smart security system 580 may be configured to store and analyze data captured by sensors on premises management devices (e.g., 130, 140, 170 as shown in FIG. 5A) and to control an entry allowance time of an armed alarm based at least in part on the data. Components of the smart security system 580 may be implemented in any of a number of ways as described above, for example, in the premises management devices themselves through load sharing, in a controller device (e.g. 160 as shown in FIG. 5A) of the premises management system, in a cloud-based or network-connected server, or in a local network-connected computing device.

The data buffer 582 may receive and temporarily store data from sensors. The data buffer 582 may receive data on an on-going basis or may be triggered to begin receiving data based on an event, such as the setting of the alarm to an AWAY mode or the opening of a door while the alarm is set to AWAY mode.

The data log 600 may receive data from the data buffer 582 and store the data for a longer term than data is stored in the data buffer 582. Data may be selectively stored in the data log 600. For example, the data log 600 may store data according to a rule or algorithm that is applied based on an amount of storage space available in the system.

FIG. 6 shows a data log 600 implementation of a rule that only stores data samples in sets that include an alarm activation event, a subsequent alarm deactivation event and all detected intervening events. For example, at 610 an alarm activation event occurs, i.e., the front door is open. The data indicating this event is moved over from the data buffer 582 and stored in the data log 600. At 620 a number of events are detected, all of which are stored in a time log manner in the data log 600, along with an identifier of the device that captured the data. At 630 the alarm is deactivated, and the data set is complete. Under this rule, data indicating other events in the premises are not stored in the data log 600 until an alarm activation event occurs again, which will initiate the storing of a new data set in the data log 600.

FIG. 6 shows merely one example storage rule. Other rules may be implemented, for example, to store data in the data log 600 on a periodic basis, or to store data only from select devices, or other rules that may reduce, focus or classify the amount and/or type of data that is stored long term in the data log 600. Furthermore, the data log 600 may be configured to store data for a set period of time, e.g., one week, the last 30 days, the last 90 days, or the like.

The data storage rule and data storage period applied by the data log 600 may change, for example, based on a command or setting, based on available storage capacity, or based on a given mode of the smart security system 580. For example, if the smart security system 580 is configured to be implemented by premises management devices in a dynamic premises management system 100 with a potentially changing configuration, then the data storage capacity may change when new devices are added or removed from the system, and the data storage rule may be automatically adjusted accordingly.

Referring to FIG. 5B, over a period of time, the data log 600 may store captured data from the buffer 582 that indicates detected entry times and subsequent alarm disarm times. After a threshold amount of data has been stored in the data log 600, for example, after a certain data set that indicates entry and disarming of the alarm has been stored in the data log 600 greater than a predetermined number of repetitions, the entry allowance calculator 584 may automatically determine one or more estimate travel times based on the repeated data sets. Herein, a "travel time" refers to an amount of time that transpires between a detected entry into the premises and a disarming of an alarm in the premises via an authorized manner, e.g., entering a personal identification number (PIN), providing biometric authentication, swiping a card, etc.

The entry allowance calculator 584 may determine one or more estimate travel times based on the history of data stored in the data log 600 and settings designated by the user. The one or more estimate travel times may include estimates that correspond to specific situations or individuals, or various combinations of the two. For example, the calculator 584 may be configured to determine an estimate travel time per person, per time of day, per time of year, per premises entry, or any combination of these or other circumstances applicable to the premises. In addition, the disclosed smart security system can be configured to determine estimates with different levels of strictness in order to provide a user with options as to how conservative or strict the estimate travel time will be.

The calculator 584 may store the various calculated estimate travel times in the entry allowance database 700, as shown in FIG. 7. The entry allowance calculator 584 may use multiple techniques, methods, or algorithms as well as different types of data to determine the estimate travel times. The entry allowance calculator 584 may therefore be configured to store metadata 720 corresponding with the estimate travel times 710. The metadata 720 may indicate additional information, such as the corresponding situation that the estimate travel time 710 is based upon and/or a level of strictness of the estimate travel time.

In one embodiment, to determine an estimate travel time with a low level of strictness, the entry allowance calculator 584 may be configured to calculate a maximum travel time over a time period based on the history of data stored in the data log 600. In this case, all situations may be grouped together. The entry allowance calculator 584 may determine the estimate travel time to be equal to the maximum travel time plus a buffer amount of time. For example, the maximum travel time over the time period may be 17 seconds. With a buffer value of 5 seconds, the estimate travel time may be calculated to be: 17 sec+5 sec=22 seconds. The entry allowance calculator 584 may store this value as an estimate travel time in the entry allowance database 700, as shown in the first entry in the entry allowance database 700 in FIG. 7. The entry allowance calculator 584 may be further configured to store corresponding metadata that classifies this estimate, for example, as an estimate with a low strictness level.

The entry allowance calculator 584 may further be configured to determine an estimate travel time with a higher level of strictness by calculating an average travel time and a maximum travel time over a time period in the history of data stored in the data log 600. For example, the calculator 584 may determine that over the past thirty days the maximum travel time was 40 seconds and the average travel time was 11 seconds. Based on these calculations, the entry allowance calculator 584 may determine an estimate travel time to be a time greater than the average time but less than the maximum time. For example, the estimate time may be determined to be the average of the maximum travel time and the average travel time. The entry allowance calculator 584 may store corresponding metadata that classifies this as an estimate with a stricter setting than the estimate described above.

Other algorithms may be used to determine the estimate travel time, with different algorithms falling within a range of strict to conservative entry allowance times in different ways. For example, the entry allowance calculator 584 may be configured to determine a median travel time over a period of time in order to minimize the weight of outlier values and determine the estimate travel time to be the median value or the median value plus a buffer value as a third general estimate stricter than the first and second general estimates. These methods are merely examples. Other algorithms may be used within the scope of the disclosed smart security system.

Furthermore, the entry allowance calculator 584 may factor in additional data or techniques to determine estimates for specific situations. For example, data may be stored or sorted into groups that indicate similar circumstances and the entry allowance calculator 584 may be configured to determine estimate travel times per group. For example, data may be sorted into groups in the data log 600 according to blocks of time within a day, e.g., 'morning', afternoon', 'evening', etc. Accordingly, the entry allowance calculator 584 may determine that an estimate travel time in a morning hours block is lower than an estimate travel time in an evening hours block.

In another embodiment implementing estimate travel times for specific situations, the data in data log 600 may be stored, sorted or grouped according to a given entrance into the premises. In this case, the entry allowance calculator 584 may determine an estimate entry allowance specifically per entrance. Accordingly, the entry allowance calculator 584 may determine that an estimate travel time from, for example, the back door out of kitchen 520, is lower than an estimate travel time from the front door in living room 510.

In another embodiment the data may be sorted or grouped according to a specific individual. The individual may be identified in any of various ways. For example, referring to FIG. 5A, the individual may be recognized by sensors such as cameras with facial recognition (e.g., individual C is recognized upon entry by camera 170), by a communication from a device carried by the user, such as in a geo-fence setup (e.g., individual B may be recognized by a communication from mobile phone 180), or by other identifying techniques. In this case, the entry allowance calculator 584 may determine an estimate entry allowance per individual. Accordingly, the entry allowance calculator 584 may determine, for example, an estimate travel time for individual C that is lower than an estimate travel time for individual B.

Referring back to FIG. 5B, the smart security system may also include a user interface 588, such as a touchscreen, keypad, touchpad or the like, through which a user may enter data and adjust system settings. The interface 588 may be implemented in a control device (e.g., 160 in FIG. 5A) associated with the smart security system or may be implemented in a control device associated with the overall premises management system. The interface 588 may alternatively be implemented via a network connection with a computing device such as a mobile phone, tablet, laptop, desktop, watch, wearable technology, set top box, console, etc.

Through the interface 588 a user may set or adjust a desired operating strictness level and a default travel time upon installation of the smart security system. During an initial installation, the smart security system may be configured to display questions through the interface 588 to guide the installer to inputting data that the smart security system may use to calculate default settings. The questions may include, for example, identifying how many entrances there are to the premises, providing an estimate distance each entrance is away from the controller device, and layout information such as the size of the premises, the relative location of the controller device, the number of floors, etc. The initial set up is not required, but may be useful for increasing the accuracy of the default settings. Based on the initial setup data, the smart security system can determine a default travel time, for example, by calculating an amount of time an average human being would need to walk to the controller device from the entrance and adding a buffer time to this amount.

Referring to FIG. 5B, the entry allowance designator 586 is configured to receive recently captured current data from sensors in the system 100 and may receive current data from other subsystems in the premises management system. Such current data may include environmental data, such as time, temperature, system status, etc. Based on the received data, the entry allowance designator 586 selects an estimate travel time from the entry allowance database 700 according to the present situation as determined from the available data. For example, referring to FIG. 7, when individual C arrives during the evening in the winter, the entry allowance designator may select an estimate travel time of 18 seconds as the entry allowance.

If no appropriate estimate travel time presently exists for a given situation, for example, not enough data has been stored in the data log 600 for the entry allowance calculator to determine an estimate travel time for the situation, then the entry allowance designator 586 may select a default travel time. The entry allowance designator 586 outputs either the selected estimate travel time or the default travel time to the system 100 to be used as the initial entry allowance time.

In one embodiment the entry allowance designator may factor in data that indicates a relative "riskiness" of the entry situation and increase or decrease entry allowance time accordingly. For example, if a user drives home and enters an established geo-fence bubble, a signal generated based on this event may be viewed as an indication to the smart security system that an authorized user is approaching. The system may assess this to be a relatively low risk situation. In this case, if the door is opened some predetermined amount of time after the low risk assessment, the user smart security system could give the user more time to disarm the alarm. On the other hand, if the system detects that an entryway is opened in a historically unusually entrance (e.g., a window or balcony door outside of a second floor bedroom) at a time when the system was armed for AWAY and no individuals are detected within the premises, the smart security system may assess this to be a relatively high risk situation. In this case the entry allowance time could be shortened.

The amount of remaining entry allowance time may be dynamically adjusted one or more times based on events that occur after a user has entered the premises. This feature allows the smart security system to better match the total entry allowance to the situation that is actually unfolding in real time in the premises. In this case, the data in data log 600 may be stored, sorted or grouped according to one or more paths that a user may take through the premises from an initial entry to an authentication device, and the entry allowance calculator 584 may determine one or more specific estimate travel times per path. A user's path may be detected and defined by the smart security system, for example, based on sensor data that represents detection of one or more events that occur in between the detected entry and the disarming of the alarm. The detected events could be movement, presence, sound or any other indication of the user moving through the premises.

For example, referring to FIGS. 5A and 5B, during winter months a user that parks beside the premises and enters through the side door near den 540 may habitually hang up her coat in a closet in the den 540, then proceed through the dining room 530, into the kitchen 520, and enter a pin number in the control device 160 on the wall. These activities may amount to a path that the user takes repeatedly prior to disarming the alarm. After the user has taken the path enough times for the data log 600 to store more than the threshold amount of repetitions required, the entry allowance calculator 584 may determine an estimate travel time specific to this path (as well as to the time of year, e.g., annual season).

After the smart security system has identified one or more paths based on the data in the data log 600, the smart security system may set an initial entry allowance time and adjust the time as the system receives data indicating that the user is traveling along an established path.

In one embodiment, the disclosed smart security system include a communication component configured to transmit a notification to a user if an entry occurs that is unusual or unexpected, for example, an entry at a time that is outside of time range in which entries have historically occurred based on stored data. A "notification" as used herein may refer to an electronic or telephonic message, such as an email, text message, or other form of electronic communication. The notification may include a description of the situation that triggered the transmission of the notification. Using a notification as a pre-alarm in this manner may further reduce false alarms and improve the chance of appropriately reducing the entry allowance time (i.e., to quickly detect an intruder). Specifically, the notification may function as a mechanism to flag certain situations to a user's attention. If the user perceives the situation to be a threat (e.g. if the user is away when the initial sensor was tripped that triggered the notification), then the user can take appropriate action, e.g., remotely sound a panic alarm and trigger an instant alert. Otherwise, if the user does not respond, the system may proceed with selected entry allowance time.

Figure 8:
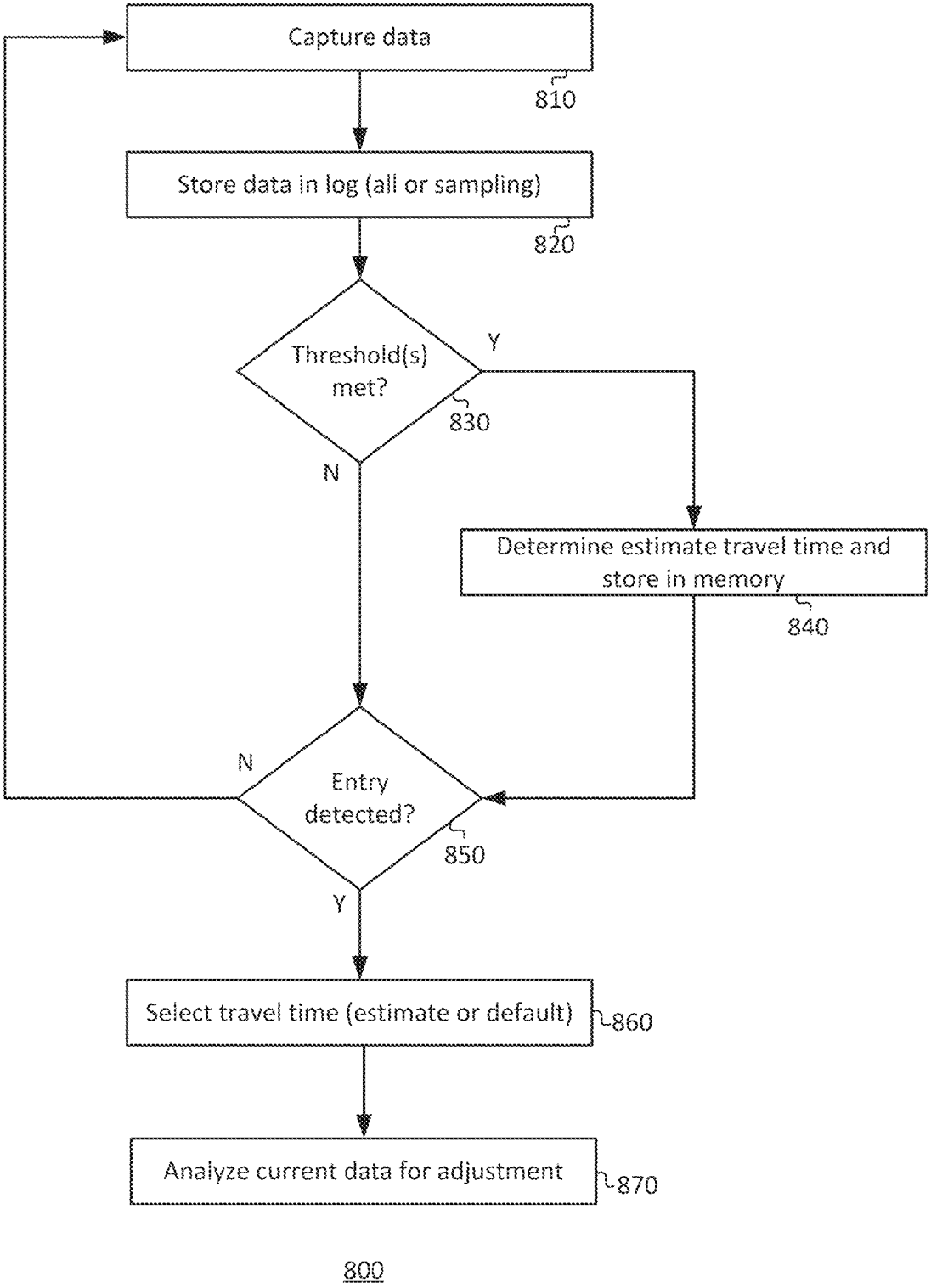
FIG. 8 shows a flowchart according to an embodiment of the disclosed subject matter.

FIG. 8 shows a flow chart 800 of operations of an embodiment of the disclosed smart security system operating, for example, within a premises management system installed in a premises. At operation 810 a plurality of network-connected sensors capture data from the environment in and/or around the premises. The data capture may continue on an on-going basis and may include any type of measurable aspect of the environment (e.g., light, sound, motion, temperature, smoke, etc.). The captured data may be supplemented by additional data from other subsystems of the premises management system or by data from external sources such as cloud-based servers or services.

At operation 820 the data is stored in a data log. The data may be stored in a temporary buffer with a sampling of the data from the buffer being stored to the data log, or all data may be directly stored to the data log, depending on the capacity and capability of the overall system.

At operation 830, a processor analyzes the data to determine whether one or more thresholds have been met. The thresholds may include, for example, a minimum amount of stored data, a minimum amount of time that the stored data covers, a minimum number of times that a given data set has occurred in the data log, or other threshold. In the case of a data set based threshold, the given data set may include data that indicates a detected entry into the premises and data that indicates a subsequent disarming of a system alarm in an authorized manner. The data set may include additional data, such as, but not limited to, data indicating detected intervening events, metadata further characterizing the data, calendar data, or other types of data.

If the processor determines that at least one threshold has been met, at operation 840 the processor determines one or more estimate travel times based at least in part on the data that meets the threshold(s). For example, various ranges of general estimates may be determined based on the detected entry times and subsequent disarm times based on maximum travel time, minimum travel time, average travel time, median travel time, buffer values, etc. Furthermore, more specific estimate travel times may be determined, for example, per individual, per time of day, per time of year, per premises entrance, per travel path or any combination of these or other circumstances based on additional data such as identity data, shared data from other subsystems, detected path data, etc. At operation 840 the processor stores the determined estimate travel time(s) in a memory.

At operation 850 if an entry is detected, the process proceeds to operation 860. When a user first enters the premises, the smart security system sets the entry allowance to a designated time. The designated entry allowance time may be selected based on recently captured data that indicates the circumstances of the entry. The data may be obtained from sensors and may be supplemented from other subsystems of the premises management system, or from external systems, such as a cloud-based service. The data may indicate any of a variety of pieces of information, including which entrance the entry occurred at, an identity of the individual, a time of day, a time of year, the outside temperature, etc. At operation 860 the processor analyzes the available data and selects either an estimate travel time or a default travel time. The smart security system sets the selected time as the entry allowance time for disarming the alarm.

At operation 870, after the entry allowance time has been set the smart security system analyzes recently captured data that indicates current events and determines whether the user is traveling on a recognized path. If the user is traveling on a recognized path, the smart security system adjusts the entry allowance time based on the estimate travel time for the recognized path. For example, if the current entry allowance time that remains is different from the amount of time that would have remained if the estimate travel time corresponding to the recognized path had been initially set upon entry detection, then the smart security system may adjust the currently remaining amount of entry allowance time to match the path estimate travel time. This may result in time being added or time being removed from the remaining entry allowance time.

Accordingly, the disclosed smart security system may learn one or more estimate travel times for situations/individuals that more closely match the actual travel times that users require in various situations. The disclosed smart security system may improve the functioning of a premises alarm by lowering the number of false alerts due to an entry allowance time being set too short. Conversely, when a manufacture or a user sets an entry allowance time higher than required by the actual individuals and the layout, the disclosed smart security system may provide the advantage of lowering the amount of time that the premises remains in a vulnerable stand-by state.

For example, a manufacturer of a conventional security system may set a default entry allowance time to 45 seconds. A typical user will not adjust this time, and even those that do often overestimate the amount of time they need. In this case, an intruder may enter the premises and have a full 45 seconds to take unscrupulous action. However, a user may improve the security of the premises by installing the disclosed smart security system, which may determine that an estimate travel time of only 15 seconds is appropriate for the layout, configuration, and typical use of the premises.

Although the disclosed smart security system may be configured to function automatically, the user may exercise control over the system and make adjustments to variable settings. Such settings may include, for example, initial data, layout details of the premises in terms of identifications of entrances and distances to entrances, a level of strictness that the user prefers the smart system to operate at regarding determining and selecting estimate travel times, a frequency as to how often estimate travel times should be updated, a length of time that data may be stored in the system, details regarding integration with other premises management systems, details regarding identification of users, such as geo fence settings, device registration, image registration, bio data registration, etc.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

The aforementioned systems/circuits/components have been described with respect to interaction between several components/blocks. A person of ordinary skill in the art would appreciate that such systems/circuits and components/blocks can include those components or specified sub-components, some of the specified components or sub-components, and/or additional components, according to various permutations and combinations of the foregoing. Sub-components can also be implemented as components communicatively coupled to other components rather than included within parent components (hierarchical). Additionally, it should be noted that one or more components may be combined into a single component providing aggregate functionality or divided into several separate sub-components, and any one or more middle layers, such as a management layer, may be provided to communicatively couple to such sub-components in order to provide integrated functionality. Any components described herein may also interact with one or more other components not specifically described herein but known by those of ordinary skill in the art.

While, for purposes of simplicity of explanation, some of the disclosed methodologies are shown and described as a series of acts within the context of various block diagrams and flowcharts, it is to be understood and appreciated that embodiments of the disclosure are not limited by the order of operations, as some operations may occur in different orders and/or concurrently with other operations from that shown and described herein. For example, those skilled in the art will understand and appreciate that a methodology can alternatively be represented as a series of interrelated states or events, such as in a state diagram. Moreover, not all illustrated operations may be required to implement a methodology in accordance with the disclosed subject matter. Additionally, it is to be further appreciated that the methodologies disclosed hereinafter and throughout this disclosure are capable of being stored on an article of manufacture to facilitate transporting and transferring such methodologies to computers. The term article of manufacture, as used herein, is intended to encompass a computer program accessible from any computer-readable device or storage media.

More generally, various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A system comprising:

a plurality of sensors installed at a premises to capture data from an environment;

a memory configured to store data captured over at least a first period of time; and a processor configured to:

determine, based on the stored captured data, an estimate travel time for a user to enter the premises and disarm an alarm system installed in the premises, and set an entry allowance of the alarm system based on the estimate travel time when one or more of the plurality of sensors detects an entry into the premises, wherein the processor is configured to determine a plurality of estimate travel times corresponding to multiple respective entry situations, and the entry situations include variations in one or more of: an identification of an individual entering the premises, and an identification of an entrance in the premises through which the entry was detected.

2. The system of claim 1, wherein the processor is configured to determine the estimate travel time by:

determining, based on the stored data, a maximum time value and an average time value between: 1) entry of the user as detected by a first sensor disposed at a first entrance to the premises, and 2) the user's successful disarming of the alarm system, the maximum time and the average time values being determined over the first period of time; and determining the estimate travel time based on one or both of the maximum time value and the average time value.

3. The system of claim 2, wherein the processor is further configured to determine the estimate travel time to be a value between the maximum time value and the average time value.

4. The system of claim 2, wherein the processor is further configured to determine the estimate travel time to be a value greater than the maximum time value.

5. The system of claim 2, wherein the processor is further configured to determine the estimate travel time by:

determining, based on the stored data, a second maximum time value and a second average time value between: 1) entry of the user as detected by a second sensor disposed at a second entrance to the premises, and 2) the user's successful disarming of the alarm system, the second maximum and the average time values being determined over the first period of time; and determining the estimate travel time based on one or both of the maximum time value and the average time value associated with the second entrance.

6. The system of claim 1, wherein the processor is configured to determine the estimate travel time by:

determining, based on the stored data, respective maximum time values and average time values between: 1) the user's entry as detected by sensors disposed at a plurality of entrances to the premises, and 2) the user's successful disarming of the alarm system;

determining, based on recently captured data, which entrance among the plurality of entrances the detected entry by the user is occurring through; and determining the travel time based on one or both of the maximum and average time values associated with the determined entrance.

7. The system of claim 1, wherein the processor is configured to determine the estimate travel time by:

determining, based on the stored data, respective maximum time values and average time values from: 1) entry of the user as detected by a sensor disposed at an entrance to the premises, to 2) a presence of the user being detected by one or more sensors disposed along a path within the premises, to 3) the user's successful disarming of the alarm system; and determining the estimate travel time based on one or both of the maximum and average time values.

8. The system of claim 1, wherein the processor is further configured to adjust the entry allowance after an entry has been detected based on recently captured data from the plurality of sensors.

9. The system of claim 1, wherein the processor is configured to:

receive data indicating a distance between: 1) a sensor disposed at an entrance to the premises, and 2) an alarm disarming device disposed within the premises;

determine an initial travel time based on the received data; and update the estimate travel time when the stored amount of captured data reaches a threshold amount.

10. A method of controlling an entry allowance, comprising:

capturing data with a plurality of network connected sensors installed in or around a premises;

storing the data in an electronic storage device over a period of time analyzing the stored data with a processor to determine, based on the stored data and on recently captured data, an estimate travel time for a user to disarm an alarm system installed in the premises; and setting an entry allowance time for a security system based on the estimate travel time when the recently captured data indicates that an individual has entered the premises, wherein the processor is configured to update the estimate travel time when a threshold number of actual travel times falls outside of a threshold range of the estimate travel time.

11. A method of controlling an entry allowance, comprising:

capturing data with a plurality of network connected sensors installed in or around a premises;

storing the data in an electronic storage device over a period of time;

analyzing the stored data with a processor to determine, based on the stored data and on recently captured data, an estimate travel time for a user to disarm an alarm system installed in the premises; and setting an entry allowance time for a security system based on the estimate travel time when the recently captured data indicates that an individual has entered the premises, wherein the estimate travel time is determined based at least in part on an identity of the user.

12. The method of claim 11, further comprising adjusting the entry allowance time based on events detected by the plurality of sensors after the individual has entered the premises.

13. The method of claim 11, further comprising adjusting the entry allowance time based on a risk assessment of events detected by the plurality of sensors prior to the individual entering the premises.

14. The method of claim 11, further comprising determining a plurality of estimate travel times corresponding to multiple entry situations that may occur at the premises.

15. The method of claim 11, further comprising determining the estimate travel time based at least in part on a time of day.

16. A system comprising:

one or more sensor devices to capture data that indicates information about an environment;

a memory device that stores a log of the captured data, a database of one or more estimate travel times, and one or more computer executable components; and a processor to execute the following computer executable components in the memory:

an entry allowance calculator component to calculate the one or more estimate travel times based on the log of the captured data, the one or more estimate travel times corresponding to multiple respective entry situations, and the entry situations including variations in one or more of: an identification of an individual entering the premises, and an identification of an entrance in the premises through which the entry was detected;

an entry allowance database component to store the one or more estimate travel times in the memory device with associated metadata that indicates a situation to which the corresponding estimate travel time applies; and an entry allowance designator to set an entry allowance time based on recently captured data from the one more sensors and the stored estimate travel times.

17. The system of claim 16, wherein the memory device is implemented in one or more of the sensor devices.

18. The system of claim 16, wherein the processor is implemented in one or more of the sensor devices.

19. The system of claim 16, wherein the processor is further configured to execute a communication component configured to transmit a notification to a user when recently captured data from the one more sensors indicates that an entry has occurred at a time that is outside of a range of time determined based on the data log, the notification including a description of the entry based on the recently captured data.

* * * * *